US008066124B2

(12) United States Patent
Koh

(10) Patent No.: US 8,066,124 B2
(45) Date of Patent: Nov. 29, 2011

(54) DISPOSABLE PILL COUNTING DEVICE

(76) Inventor: Ming S. Koh, Kent, WA (US)

( * ) Notice: Subject to any disclaimer, the term of this patent is extended or adjusted under 35 U.S.C. 154(b) by 78 days.

(21) Appl. No.: 12/662,315

(22) Filed: Apr. 9, 2010

(65) Prior Publication Data

US 2010/0193396 A1 Aug. 5, 2010

Related U.S. Application Data

(63) Continuation-in-part of application No. 11/414,937, filed on May 1, 2006, now abandoned.

(60) Provisional application No. 60/676,781, filed on May 2, 2005.

(51) Int. Cl.

| | |
|---|---|
| ***A61J 7/02*** | (2006.01) |
| ***B65D 85/42*** | (2006.01) |
| ***B65D 85/62*** | (2006.01) |
| ***B65D 1/34*** | (2006.01) |

(52) U.S. Cl. ..... 206/540; 30/142; 206/518; 206/557; 414/675

(58) Field of Classification Search ..... 206/518, 206/528, 540, 557–565; 30/142; 414/675; D7/543, 550.1, 554.4

See application file for complete search history.

(56) References Cited

U.S. PATENT DOCUMENTS

| | | | | | |
|---|---|---|---|---|---|
| D135,524 | S | * | 4/1943 | Johnstone | D7/550.1 |
| D141,503 | S | * | 6/1945 | Preis | D7/550.1 |
| 2,507,792 | A | * | 5/1950 | King | 414/675 |
| 2,527,694 | A | | 10/1950 | Bejcek | |
| 2,712,383 | A | | 7/1955 | Murphy et al. | |
| 2,812,076 | A | | 11/1957 | Mistretta | |
| 2,814,870 | A | | 12/1957 | Treiber | |
| 2,952,369 | A | * | 9/1960 | Rew | 414/675 |
| 3,255,894 | A | | 6/1966 | Handel et al. | |
| 3,461,643 | A | | 8/1969 | Strand | |
| 3,819,064 | A | | 6/1974 | Chandler | |
| 3,848,395 | A | | 11/1974 | Totten | |
| D248,078 | S | | 6/1978 | Warnekros | |
| 4,121,722 | A | * | 10/1978 | Sussman | 414/675 |
| D265,320 | S | | 7/1982 | Habenstein | |
| 4,851,649 | A | | 7/1989 | McCanney | |
| 7,007,838 | B1 | | 3/2006 | Bostick, II | |
| 7,392,932 | B2 | | 7/2008 | Bostick, II | |

FOREIGN PATENT DOCUMENTS

WO WO 2005/023672 3/2005

* cited by examiner

*Primary Examiner* — Bryon Gehman
(74) *Attorney, Agent, or Firm* — Richard C. Litman

(57) ABSTRACT

The disposable pill counting device is a tray formed of a disposable material and includes a sidewall to define areas for holding and dispensing pills. The disposable tray may be substantially U-shaped with a folding sidewall and can be used with a disposable spatula.

4 Claims, 10 Drawing Sheets

DISPOSABLE PILL COUNTING DEVICE

CROSS-REFERENCE TO RELATED APPLICATIONS

This application is a continuation-in-part of U.S. patent application Ser. No. 11/414,937, filed May 1, 2006, now abandoned, which claims the benefit of U.S. Provisional Patent Application No. 60/676,781 filed May 2, 2005.

BACKGROUND OF THE INVENTION

1. Field of the Invention

The present invention relates generally to health care, and more particularly to a pill counting device and method for using the pill counting device 2. Description of the Related Art Among other things, pharmacies commonly supply pills and other medication in prescription vials for holding their medication after the patients leave the pharmacy and their appointment with the doctor. Some patients when they come to the pharmacy with their prescription scripts are in pain and wish to take their medication immediately in accordance with the doctor's signa, which is a Latin term to label the prescription according to dose, route of administration and frequency of use. The only concern of the patients under these circumstances is that the medication will provide some relief from the pain that they suffer and/or cure the ailment. Since the inception of the pharmacy, the tools that have been used to fill the tablet/capsule prescription drug order has been the pill counting tray and spatula. These tools are based on technology that has been in existence for more than 80 years. However, these devices are still used today by the pharmacy to manually fill, accurately count and dispense the medication into the prescription vials. This process is repeated over and over again with the same pill counting tray and spatula. There is no attempt to prevent the contamination of the next patient's medication by the medication of the previous patient. However, many patients are allergic to some kinds of medications, and it is possible for the patient's medication to become contaminated with the previous patient's medication and for the patient to sustain a serious allergic reaction without knowledge of the source of the contamination. The contamination could occur during the filling, counting and dispensing of the patient's medication.

Thus, a disposable pill counting device solving the aforementioned problems is desired.

SUMMARY OF THE INVENTION

The disposable pill counting device eliminates the drug cross-contamination problem in the pharmacy environment. The invention relates to both a device and method of pill dispensing in which the pill-counting device is disposable. The disposable pill counting device includes a disposable pill counting tray, which may have a built-in chute and a disposable spatula for directing the pills into the medication vial.

Due to its disposable structure, the disposable pill counting device is an effective device to prevent the allergic reaction of patients caused by drug cross-contamination. With the disposable pill counting device, the patients are assured of receiving substantially pure medication from the pharmacy. It should be understood that the word 'pill' can refer to tablets, capsules or any other suitable type of pill medication that is dispensed as medication by the pharmacy.

By employing the disposable pill counting tray and disposable spatula, drug cross-contamination and the resulting induced allergies can be avoided. The common medications that induce allergic reactions include antibiotics and some heart disease medications. However, there are many other drugs that can induce the allergic response. Consequently, the disposable pill counting device is an important contribution to preventing these induced allergies.

The disposable pill counting tray and the disposable spatula are simpler in construction, cost effective, and more versatile in operation than other pill counting trays and spatulas. The disposable pill counting tray and disposable spatula ensure safety for patients. The disposable pill counting tray and disposable spatula provide a new and contamination-free device for each patient. By virtue of the disposable aspect of the disposable pill counting tray and disposable spatula, these devices can be used once and discarded.

The disposable pill-dispensing device eliminates drug cross-contamination concerns of the community. Consequently, the disposable the dispensing device provides an important contribution and solves the problem of unrecognized allergic reactions.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
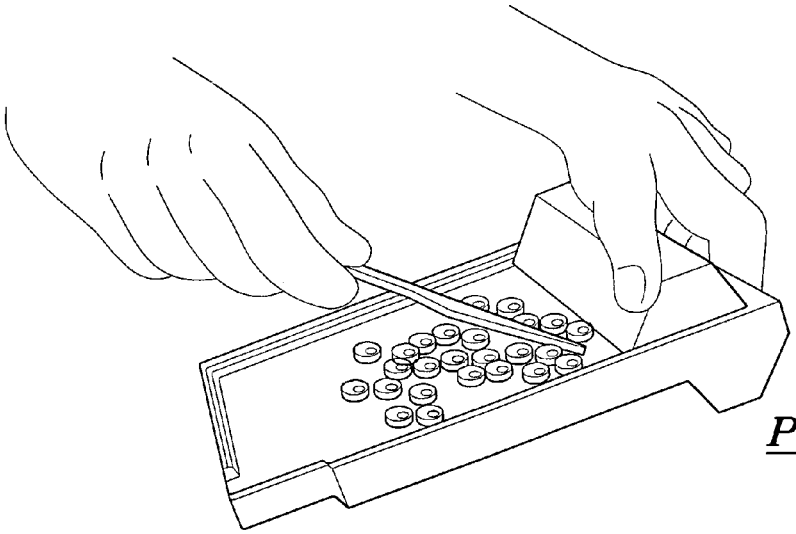
Fig. 1 PRIOR ART
FIG. 1 is an environmental, perspective view of a traditional pill counting tray and spatula according to the prior art, both of which are non-disposable.
Figure 2:
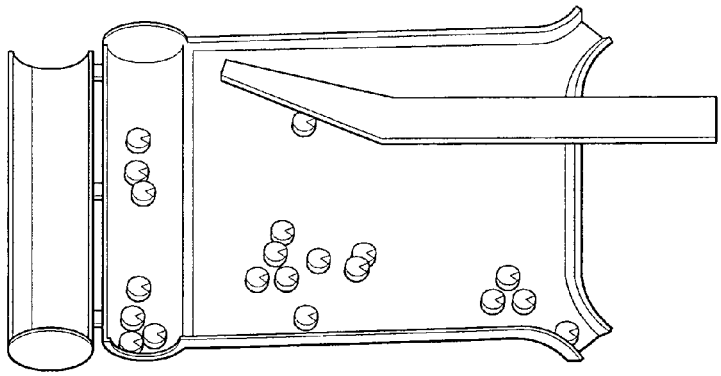
Fig. 2 PRIOR ART
FIG. 2 is a perspective view of another traditional pill counting tray and spatula according to the prior art.
Figure 3:
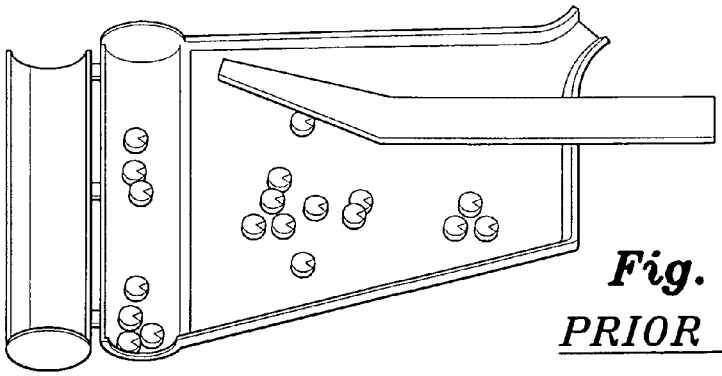
Fig. 3 PRIOR ART
FIG. 3 is a perspective view of yet another traditional, non-disposable pill counting tray and non-disposable spatula according to the prior art.
Figure 4A:
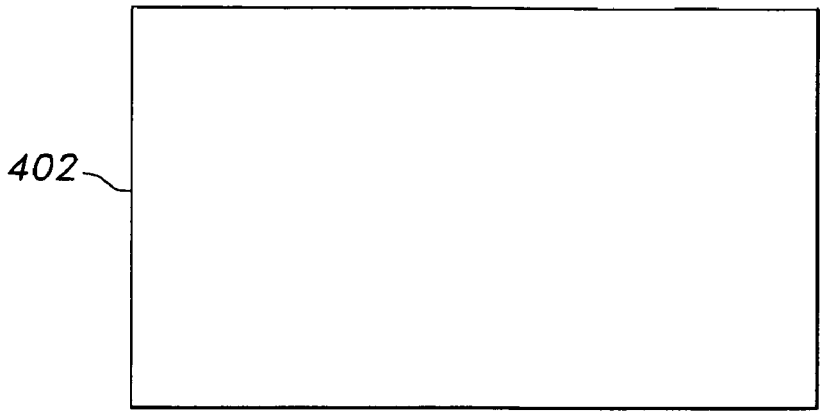
FIGS. 4A, 4B, and 4C are top plan views showing steps in the formation of a first embodiment of a tray of a disposable pill counting device according to the present invention.
Figure 4B:
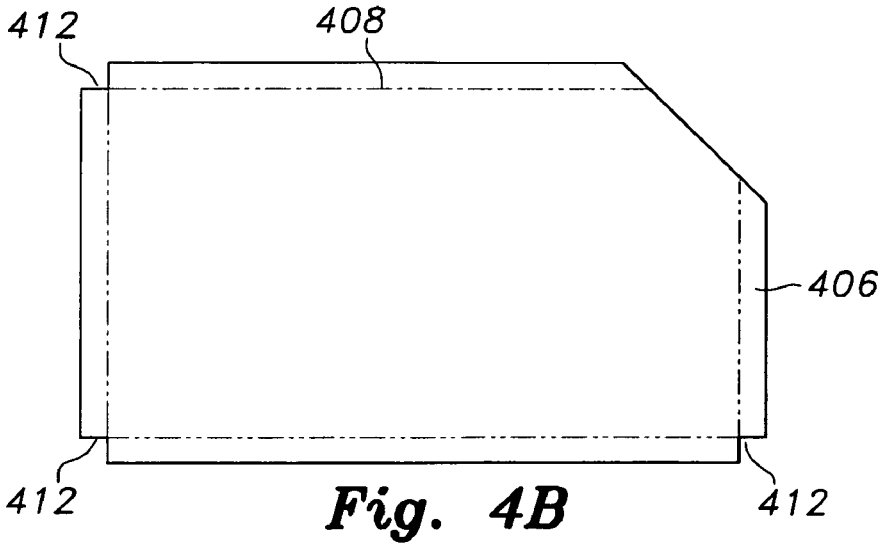
Figure 4C:
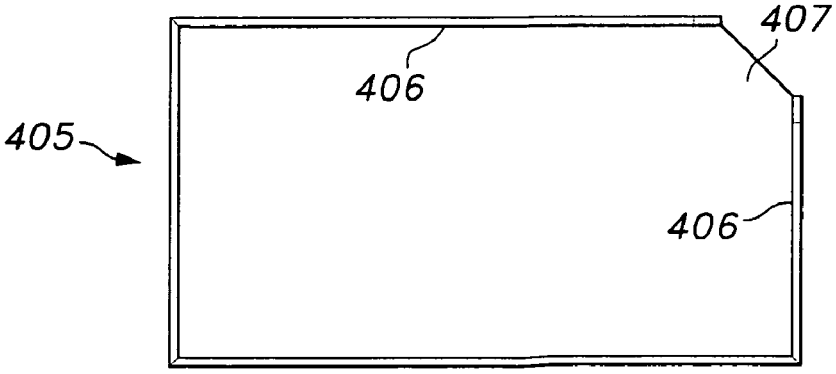

FIG. 4A illustrates a substantially flat disposable sheet 402 for forming the disposable or single use pill counting tray 405 shown in FIG. 4C. The flat disposable sheet 402 may be formed from disposable material, such as reinforced nontoxic paperboard, cardboard, rigid paper or other suitable material. The disposable sheet 402 should be safe to use in the pharmaceutical industry and may be approved by the Federal Drug Agency (FDA). FIG. 4A shows a substantially rectangle disposable sheet 402. However, other shapes of disposable sheet 402 are within the scope of the present invention.

FIG. 4B illustrates a fold line 408, which is formed along the periphery of the disposable sheet 402, and which is substantially parallel to the edges of the disposable sheet 402. The corner 412 of the disposable sheet 402 is punched out along the fold line 408 in order to form the folding sidewall 406. One corner may include a chute 407, which is formed by removing a portion of the disposable sheet 402 along the diagonal of the corner. The chute 407 may not have sidewalls. The fold line 408 may be a weakened area, such as a line of punches, or may be formed by coining to allow the folding sidewall 406 to be folded to an upright position and held upright by tape all around the sidewalls, so that the sidewall 406 substantially perpendicular to the base 404. The central area of the disposable sheet 402 forms a substantially flat area for the pills to be dispensed and counted.

FIG. 4C illustrates that the folding sidewall 406 has been moved from a first position substantially in the plane of the central area of the sheet 402 to a second position substantially perpendicular to the central area of the disposable sheet 402, but may be outwardly sloping for nesting. FIG. 4C illustrates that the chute 407 has no sidewall to allow the pills to be dispensed into the vial.

Figure 5A:
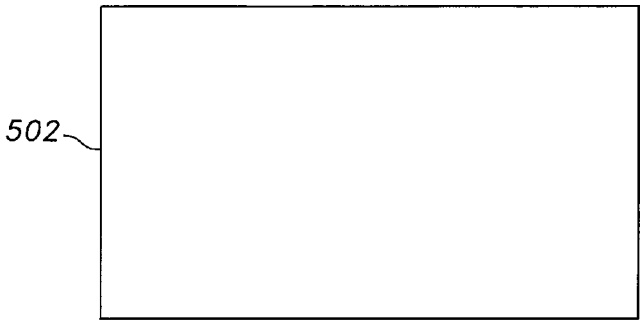
FIGS. 5A, 5B, and 5C are top plan views
Figure 5D:
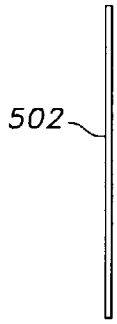
FIGS. 5D, 5E, and 5F are corresponding end views showing the formation of a second embodiment of a tray of a disposable pill counting device according to the present invention.
Figure 5B:
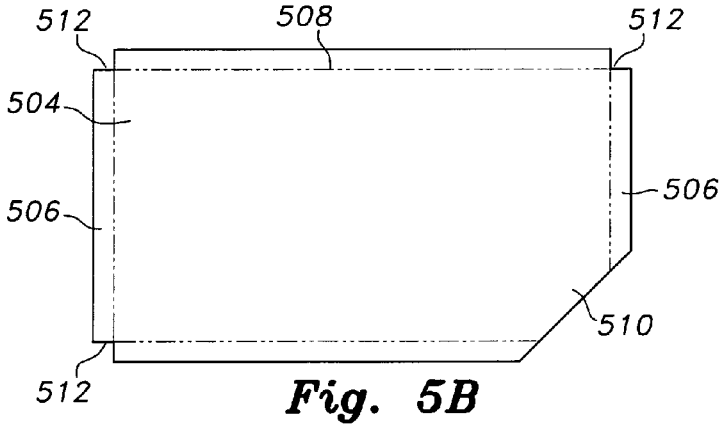
Figure 5E:
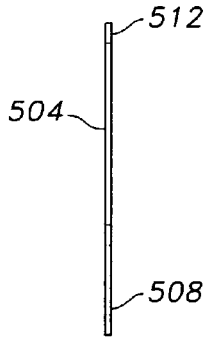
Figure 5C:
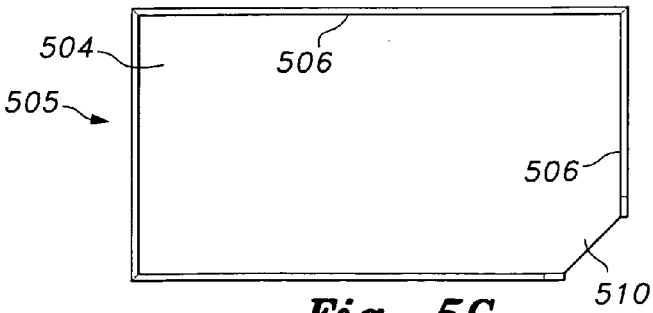
Figure 5F:
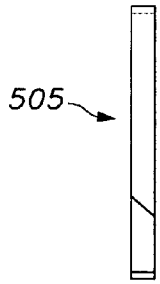

FIGS. 5A-5C illustrate a pill counting tray 505 formed in a right-handed configuration to provide ease of dispensing pills by a right-handed user. The construction of the pill counting tray 505 is similar to the construction of the pill counting tray 405. FIG. 5A shows a disposable sheet 502. FIG. 5B illustrates the central area or base 504 to form a dispensing area, and a folding sidewall 506 defined by the fold line 508 and the edge of the disposable sheet 502. The corners 512 on three sides have been punched out to allow the folding sidewall 506 to be joined. The chute 510 is formed in the lower right hand corner in order to facilitate a right-handed user. FIG. 5D illustrates an end view of the disposable sheet 502 corresponding to FIG. 5A, and FIG. 5E illustrates an end view of the base 504 corresponding to FIG. 5B. FIG. 5F illustrates an end view of the pill counting tray 505 corresponding to FIG. 5C.

Figure 6A:
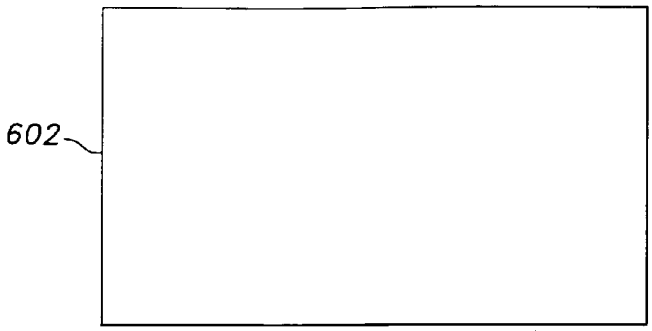
FIGS. 6A, 6B, and 6C are top plan views
Figure 6D:
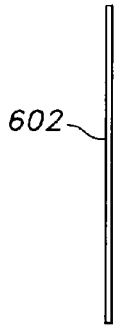
FIGS. 6D, 6E, and 6F are corresponding end views showing the formation of a third embodiment of a tray of a disposable pill counting device according to the present invention.
Figure 6B:
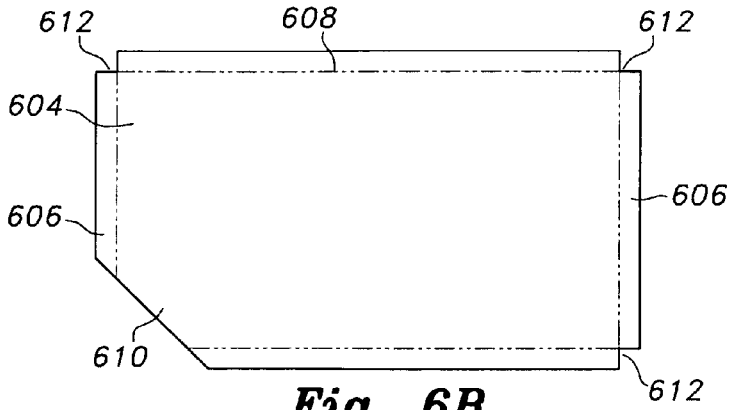
Figure 6E:
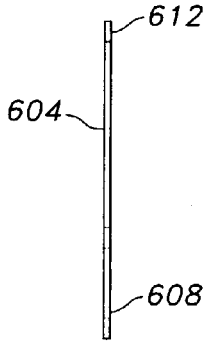
Figure 6C:
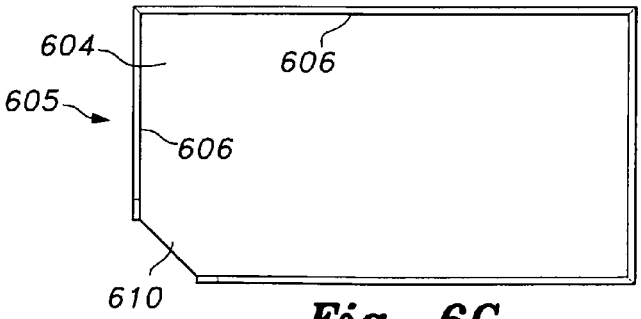
Figure 6F:
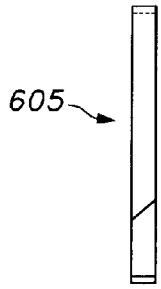

FIG. 6C illustrates a pill counting tray 605 formed in a left-handed configuration to provide ease of dispensing pills by a left-handed user. The construction of the pill counting tray 605 is similar to the construction of the pill counting tray 505. FIG. 6A discloses a disposable sheet 602. FIG. 6B illustrates the base 604 to form a dispensing area, and a folding sidewall 606 defined by the fold line 608 and the edge of the disposable sheet 602. The corners 612 on three sides have been punched out to allow the folding sidewall 606 to be joined. The chute 610 is formed in the lower left-hand corner of the pill counting tray 605 in order to facilitate a left-handed user. FIG. 6D illustrates an end view of the disposable sheet 602 corresponding to FIG. 6A, and FIG. 6E illustrates an end view of the base 604 corresponding to FIG. 6B. FIG. 6F illustrates an end view of the pill counting tray 605 corresponding to FIG. 6C.

Figure 7:
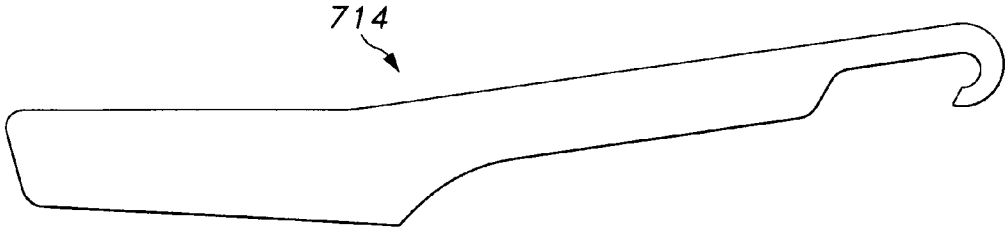
FIG. 7 is a side view of a disposable spatula of a disposable pill counting device according to the present invention.

FIG. 7 illustrates a spatula 714, which may be formed from a disposable material, such as reinforced nontoxic cardboard, rigid paper or other suitable material. The spatula 714 should be safe to use in the pharmaceutical industry and may be approved by the Federal drug agency (FDA).

Figure 8:
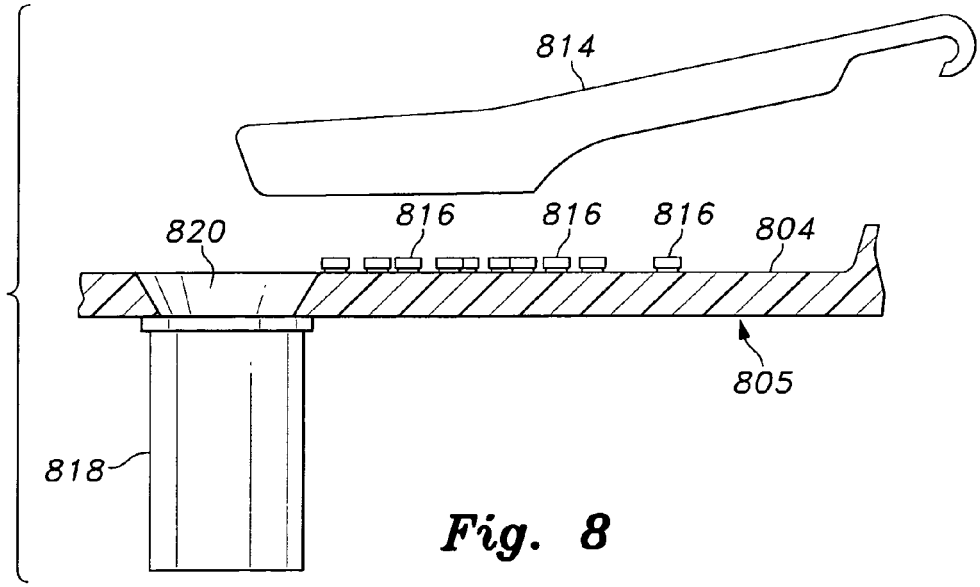
FIG. 8 is an environmental side view of a disposable pill counting device according to the present invention, illustrating the pill counting tray and the spatula being used to count pills into a vial.

FIG. 8 illustrates the disposable pill counting device, which is shown to include the disposable pill counting tray 805 used in conjunction with the disposable spatula 814. More particularly, FIG. 8 illustrates pills 816 positioned on a disposable base 804 of the disposable pill counting tray 805. The disposable spatula 814 is used to move or slide the pills 816 into an opening 820 of the vial 818. The disposable spatula 814 includes a hook to remove the cotton insert from the pill bottle.

Figure 9A:
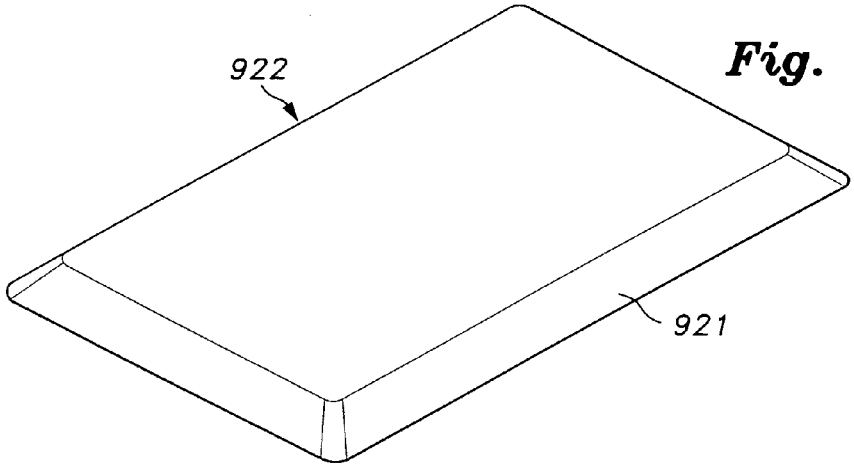
FIGS. 9A and 9B are perspective views of a tray cover according to the present invention and a plurality of the tray covers shown in stacked formation, respectively.
Figure 9B:
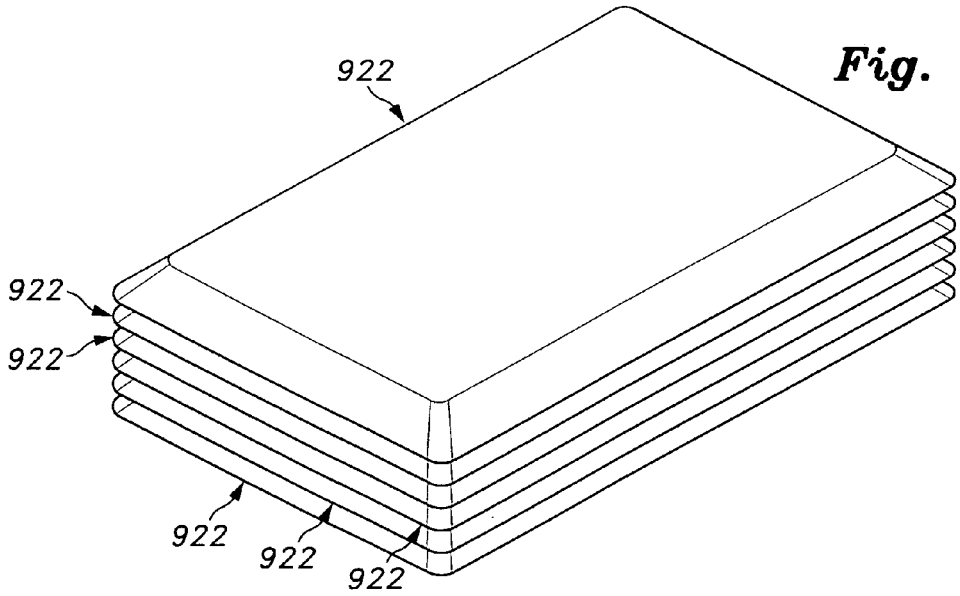

FIG. 9A illustrates an additional element of the device, viz., a tray cover 922, which could be constructed from clear plastic or any other suitable material to cover the pill counting tray. The edge 921 of the tray cover 922 may be outward sloping in order to prevent contamination of the disposable pill counting tray 405. FIG. 9B illustrates a plurality of tray covers 922, which have been stacked and nested together for convenient storage.

Figure 10A:
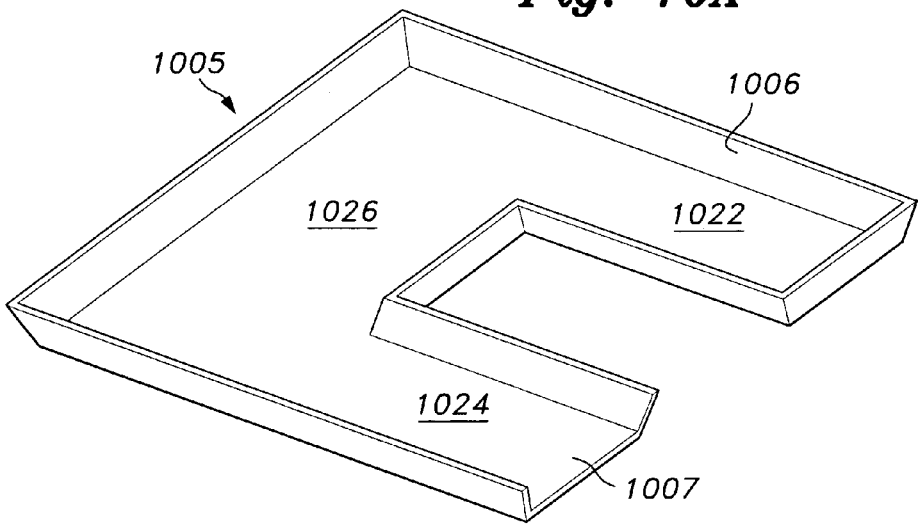
FIG. 10A is a perspective view of a fourth embodiment of a pill-counting tray of a disposable pill counting device according to the present invention.

FIG. 10A illustrates an additional pill counting tray 1005, which could be constructed from a disposable cardboard sheet, or from plastic or other suitable material. The pill counting tray 1005 is substantially U-shaped, including a first arm 1022 and a second arm 1024. The first arm 1022 could be used as a staging area for pill preparation, while the second arm 1024 could be used as a dispensing area for the pills. The flat base or connecting area 1026, which connects the first arm 1022 and the second arm 1024, could be used as a pill-pouring surface. This provides a convenient and separate area for various functions. The pill counting tray 1005 includes sidewall 1006, including seven sidewalls around the periphery of the pill counting tray 1005, except for an opening to accommodate the chute 1007.

Figure 10B:
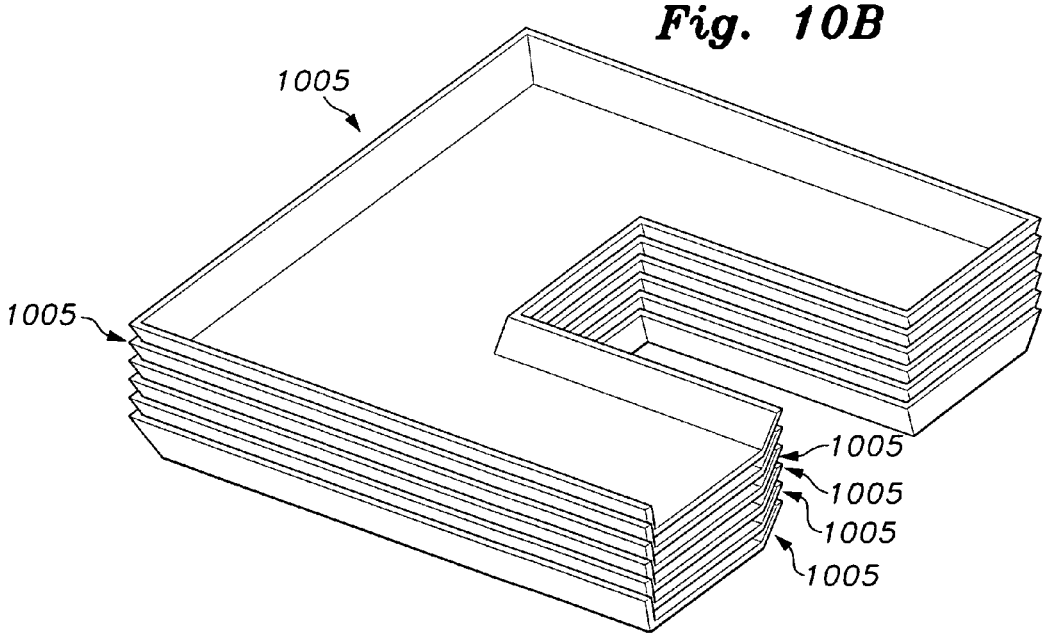
FIG. 10B is a perspective view of a plurality of the trays of FIG. 10A, shown stacked.

FIG. 10B illustrates that the sidewall 1006 is slightly outward sloping so that the pill counting tray 1005 can be stacked/nested with another pill counting tray 1005.

Figure 10C:
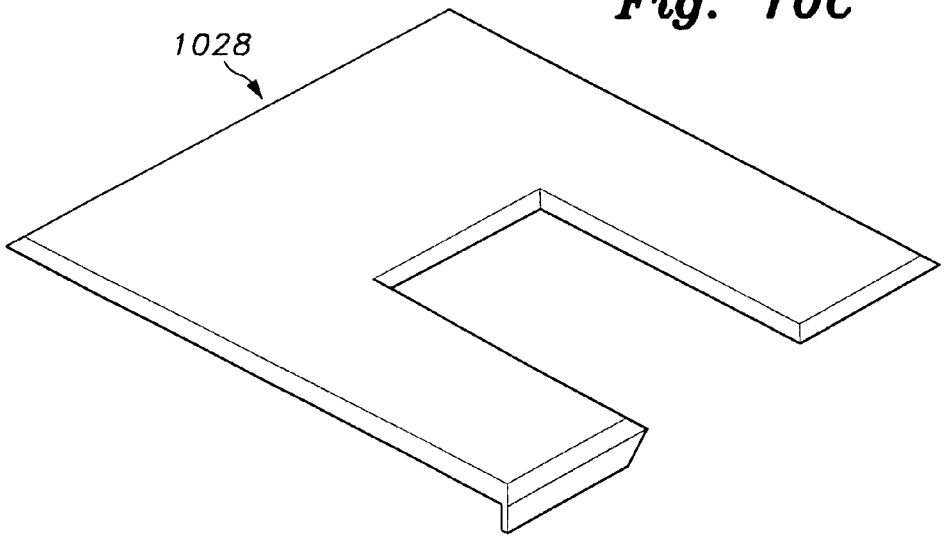
FIG. 10C is a perspective view of a cover for the pill counting tray of FIG. 10A.

FIG. 10C illustrates a tray cover 1028 to cover the pill counting tray 1005 to keep the pill counting tray 1005 free from contaminants and to keep the pills from falling out.

Figure 11A:
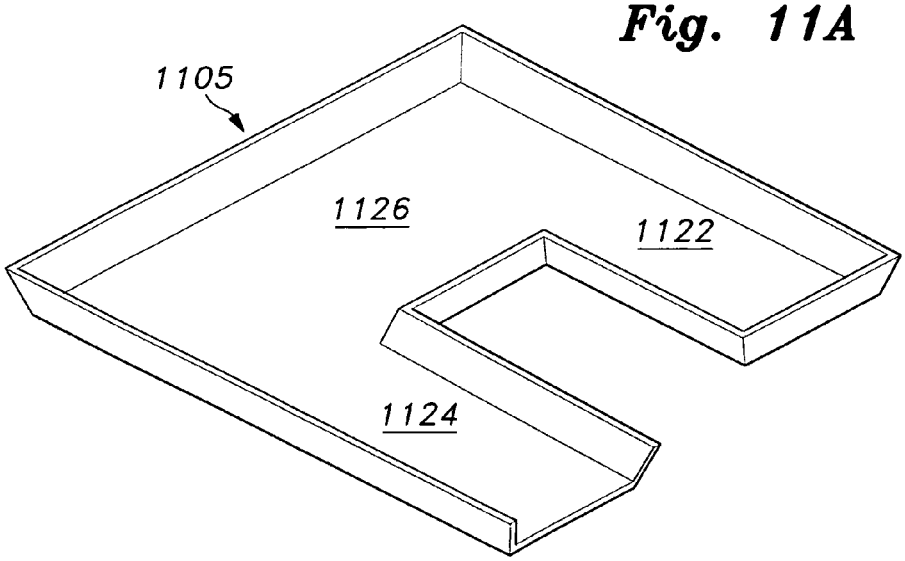
FIG. 11A is a perspective view of a fifth embodiment of a pill-counting tray of a disposable pill counting device according to the present invention.

FIG. 11A illustrates another embodiment of a pill counting tray 1105, which includes a first arm 1122, a second arm 1124 and a connecting area 1126 to connect the first arm 1122 and the second arm 1124. Whereas the arms 1022 and 1024 are substantially equal in length, the second arm 1124 extends beyond the end of the first arm 1122. The first arm 1122 can serve as a staging area for pills, and the second arm 1124 can serve as a dispensing area for dispensing the pills, the connecting area 1126 serving as a pill pouring area for pills.

Figure 11B:
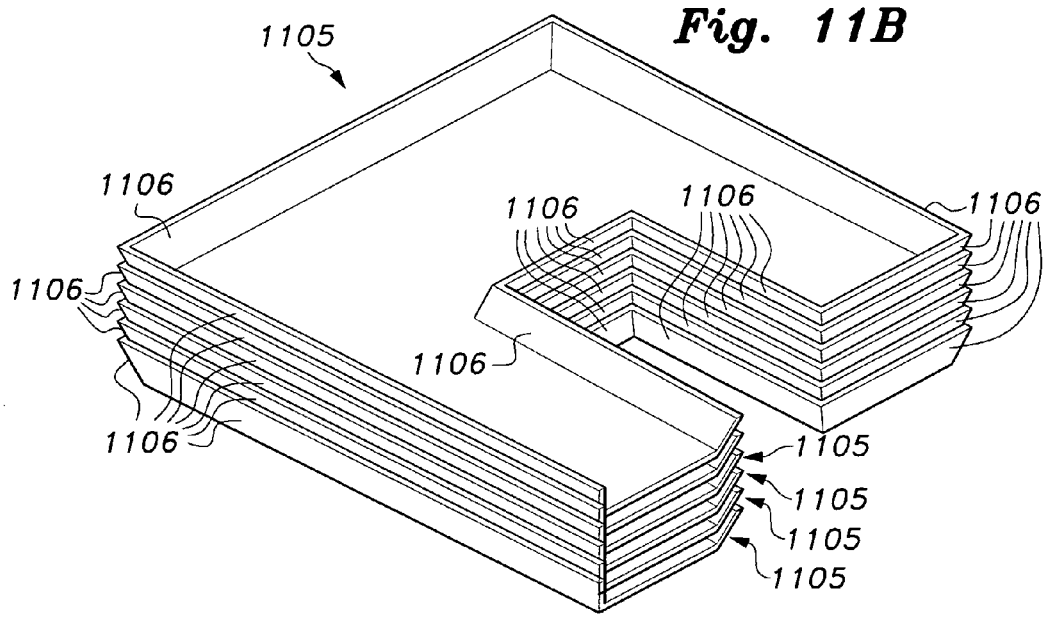
FIG. 11B is a perspective view of a plurality of the trays of FIG. 11A, shown stacked.

FIG. 11B illustrates a plurality of stacked/nested pill counting trays 1105. The sidewall 1106 of the pill counting tray

1105 is slightly outward sloping so that the pill counting tray 1005 can be stacked/nested with another pill counting tray 1005.

Figure 11C:
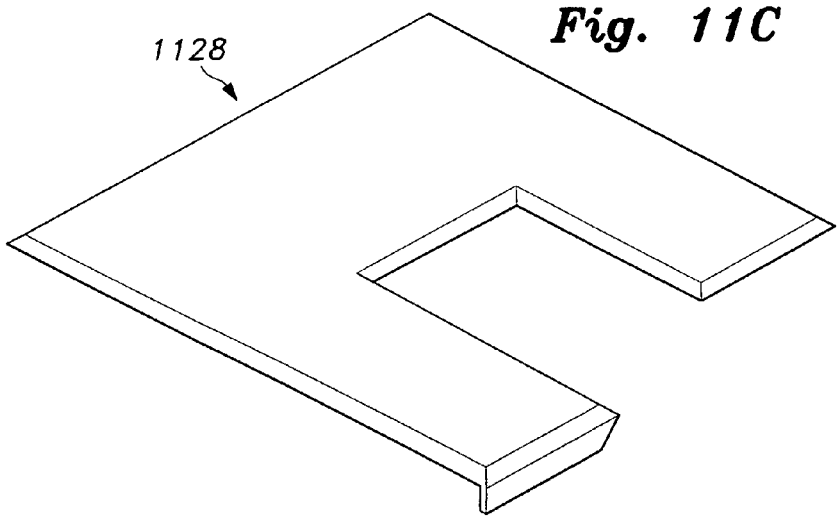
FIG. 11C is a perspective view of a cover for the pill counting tray of FIG. 11A.

FIG. 11C illustrates a tray cover 1128 to cover the pill counting tray 1105 to keep the pill counting tray 1105 free from contaminants and to keep the pills from falling out.

Figure 12:
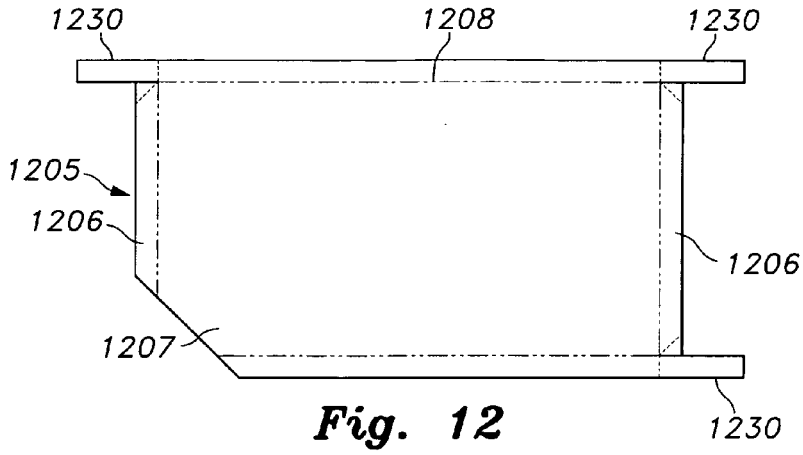
FIG. 12 is a top plan view of a pill-counting tray of a sixth embodiment of a disposable pill counting device according to the present invention, the embodiment having adhesive tape.

FIG. 12 illustrates another embodiment of a disposable pill counting device, disclosing a pill counting tray 1205 having single-sided adhesive tape 1230 or double-sided adhesive tape for adhering the pill counting tray 1205 to a surface for the convenience of the user, or for attaching sidewalls together.

Figure 13:
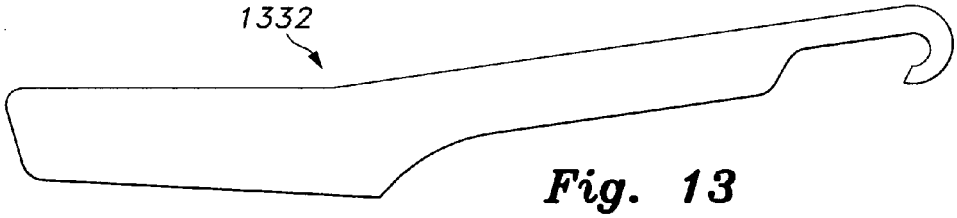
FIG. 13 is a side view of a spatula of a disposable pill counting device according to the present invention, the spatula being constructed from disposable materials.

FIG. 13 illustrates a spatula 1332, which could be constructed from disposable materials such as paperboard, cardboard, or plastic and any other such suitable material.

Figure 14:
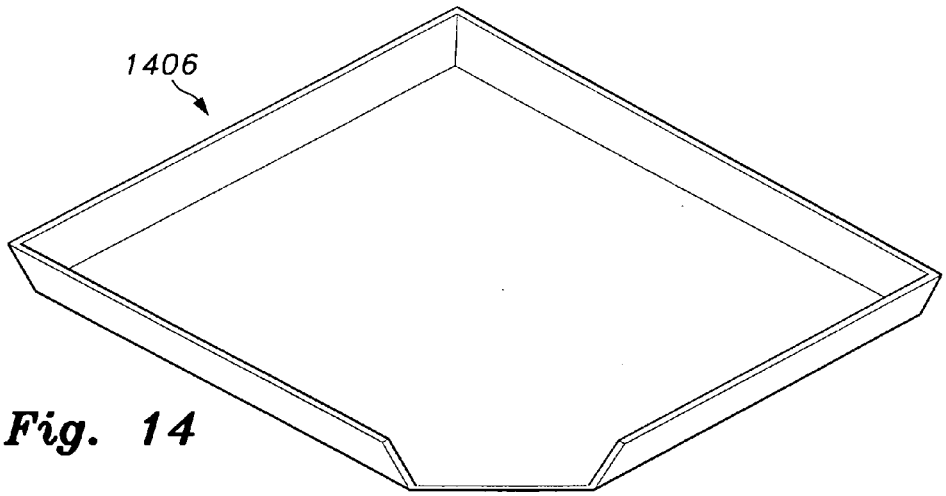
FIG. 14 is a perspective view of a pill counting tray of a seventh embodiment of a disposable pill counting device according to the present invention, the tray being stackable.

FIG. 14 illustrates a pill counting tray 1405, which may be constructed from plastic and can be stacked or nested.

It is to be understood that the present invention is not limited to the embodiments described above, but encompasses any and all embodiments within the scope of the following claims.

I claim:

1. A pill counting tray, comprising:

a substantially U-shaped planar base having sidewalls about the periphery thereof, wherein the sidewalls extend from the periphery of the planar U-shaped base and are outwardly sloping for accepting another tray to form a nested pair of trays, the U-shaped base further defining first and second leg portions along the parallel legs of the U-shaped base wherein each leg has a first portion and a terminal portion, and a distinct, separate pouring area connecting the first portions of each of the legs, the terminal portion of at least one of the legs being open.

2. The pill counting tray according to claim 1, wherein one of the leg portions is extends beyond the other.

3. The pill counting tray according to claim 1, wherein said base is formed of a disposable material selected from the group consisting of cardboard and plastic.

4. The pill counting tray according to claim 1, further including a tray cover.

* * * * *